United States Patent [19]

Hayasaka

[11] 3,970,983

[45] July 20, 1976

[54] RESISTOR WITH LOW TEMPERATURE COEFFICIENT

[75] Inventor: Isao Hayasaka, Kounosu, Japan

[73] Assignee: Takeda Riken Kogyo Kabushiki Kaisha, Tokyo, Japan

[22] Filed: Jan. 27, 1975

[21] Appl. No.: 544,451

[30] Foreign Application Priority Data

Jan. 30, 1974 Japan ..... 49-12457

[52] U.S. Cl. ..... 338/9; 338/302; 338/320

[51] Int. Cl.[2] ..... H01C 7/06

[58] Field of Search ..... 338/9, 10, 7, 302, 320, 338/48

[56] References Cited

UNITED STATES PATENTS 381,304 4/1888 Weston ..... 338/10

1,985,691 12/1934 Pugh, Jr. ..... 338/10

*Primary Examiner*—C. L. Albritton

*Attorney, Agent, or Firm*—Elliott I. Pollock

[57] ABSTRACT

A resistor with a low temperature coefficient comprises, by way of example, a main wire wound resistor having a low temperature coefficient on the order of −4.0 PPM and a resistance on the order of 1 KΩ connected in series with an auxiliary resistor having a temperature coefficient the magnitude of which is substantially greater than that of the main resistor and the polarity of which is opposite to that of the latter, for example, on the order of 4000 PPM and having a resistance which is greatly reduced as compared with that of the main resistor, for example, on the order of 1Ω. The composite resistor has a resistance of approximately 1 KΩ and a temperature coefficient which is less than 0.5 PPM.

5 Claims, 6 Drawing Figures

RESISTOR WITH LOW TEMPERATURE COEFFICIENT

BACKGROUND OF THE INVENTION

The invention relates to a resistor having an extremely low temperature coefficient which may be as low as less than ±0.5 PPM.

In the application of a digital voltmeter, an input to be determined is directly supplied to the voltmeter when it ranges from 1 to 10 volts, but where the input exceeds 10 volts, the input is passed through a voltage divider comprising resistors so that a voltage within said range can be supplied to the voltmeter. It is desirable that such a resistance type voltage divider have a high resistance and a low temperature coefficient. In order to avoid the influence of the ambient temperatures upon the result of determination, the voltage divider is contained within a thermostatic vessel when a high accuracy is demanded, with consequent increase in the cost and the space for the thermostatic vessel. An additional disadvantage of such system is the considerable length of time which must be allowed when the power is turned on until the thermostatic vessel reaches a stable operative condition. Therefore, it is apparent that there has been a need for resistors which can be made to have a low temperature coefficient, without recourse to the thermostatic vessel.

Among commercially available resistors, the minimum temperature coefficient found in the prior art is on the order of ±0.0001%/°C or ±1.0 PPM/°C. While resistors having such a degree of temperature coefficient are available in the market, they are manufactured by only one company in the world and are available on order with a special specification, and therefore are highly expensive. Even with such expensive products, variations are found from product to product, so that it is necessary to select resistors having a temperature coefficient less than ±1 PPM/°C for use. Where a resistance wire is wound on a bobbin, variations in the temperature coefficient achieved after the completion of the winding operation increases unless the material of the bobbin, as well as tension, temperature and humidity during the winding process are properly controlled. As a consequence, it is generally believed to be impossible to manufacture resistors for industrial purposes having a temperature coefficient on the order of ±1 PPM/°C, and resistors having temperature coefficients on the order of ±5 PPM/°C are accepted as standard resistors.

It is an object of the present invention to provide an inexpensive resistor with an extremely low temperature coefficient which may be as low as less than 0.5 PPM/°C, for example.

It is another object of the invention to provide a resistor with a low temperature coefficient which has good stability and lends itself to mass production.

It is a further object of the invention to provide a method of manufacturing a resistor with a low thermal coefficient for which the middle temperature of a null thermal coefficient range can be freely chosen.

SUMMARY OF THE INVENTION

In accordance with the invention, a main wire wound resistor having a low temperature coefficient is connected in series with an auxiliary resistor. The auxiliary resistor has a temperature coefficient the polarity or sign of which is opposite to that of the main resistor and the magnitude of which is relatively high, and has a resistance which is made sufficiently smaller than that of the main resistor. The temperature coefficients of the main and auxiliary resistors are chosen such that they cancel each other to make the overall temperature coefficient at the temperature of use substantially null.

DETAILED DESCRIPTION OF AN EMBODIMENT

Figure 1:
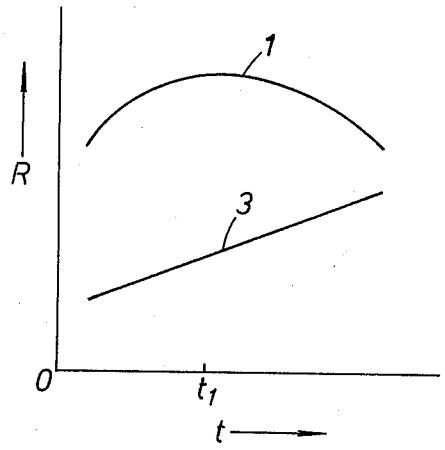
FIG. 1 graphically shows variations of resistances of certain resistors as plotted against temperature.
Figure 2:
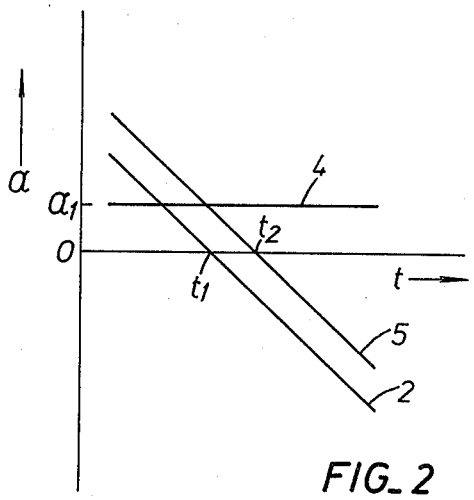
FIG. 2 graphically shows variations of the temperature coefficient of resistors as plotted against temperature.

A currently available resistance wire which has a good temperature response exhibits a resistance (R)-temperature ($t$) characteristic as represented by a curve 1 in FIG. 1. The resistance R can be approximately expressed by a quadratic equation $R = at^2 + bt + c$, with the coefficient $a$ of the first term being negative. The temperature coefficient $\alpha$ of such resistor is given by the following equation.

$$\alpha = \frac{\delta R}{\delta t} = 2at + b$$

as represented by a line 2 in FIG. 2. If such a resistor is used at a temperature $t_1$ where the value of $\alpha$ becomes equal to 0, a variation in the resistance due to temperature change remains minimal. However, the temperature $t_1$ at which $\alpha = 0$ generally varies widely, and does not coincide with the temperature of use. In accordance with the invention, use is made of an auxiliary resistor such as a copper wire, for example, having a temperature or thermal coefficient which is of the opposite polarity or sign to that of the main resistor and the magnitude of which is relatively high. The resistance-temperature characteristic of the copper wire is substantially rectilinear as represented by a line 3 in FIG. 1, and its temperature coefficient remains at a constant value $\alpha_1$ as illustrated by a line 4 in FIG. 2. By connecting this auxiliary resistor of a proper value in series with the main resistor having a characteristic as represented by the curve 1 in FIG. 1, it is possible to shift the temperature coefficient of the overall resistor parallel to the ordinate of FIG. 2 to a position as indicated by a line 5, for example, which crosses the abscissa $\alpha = 0$ at a temperature $t_2$ which represents a desired temperature or the temperature of use, the amount of shift being in proportion to the ratio of the resistance of the resistor the characteristic of which is represented by the curve 1 and the resistance of the auxiliary resistor.

Figure 3A:
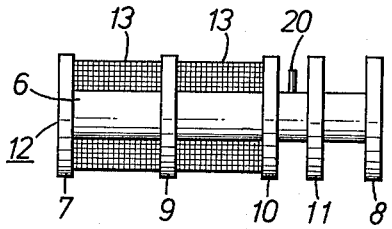
FIGS. 3A and 3B are front views illustrating one exemplary method of manufacturing the resistor with low temperature coefficient according to the invention.
Figure 3B:
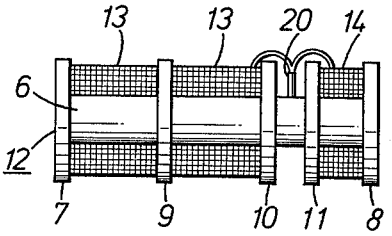
Figure 4:
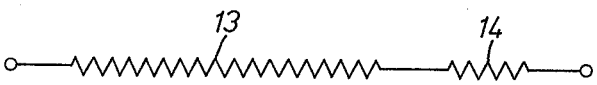
FIG. 4 is an electrical equivalent circuit of the resistor with a low temperature coefficient according to the invention.
Figure 5:
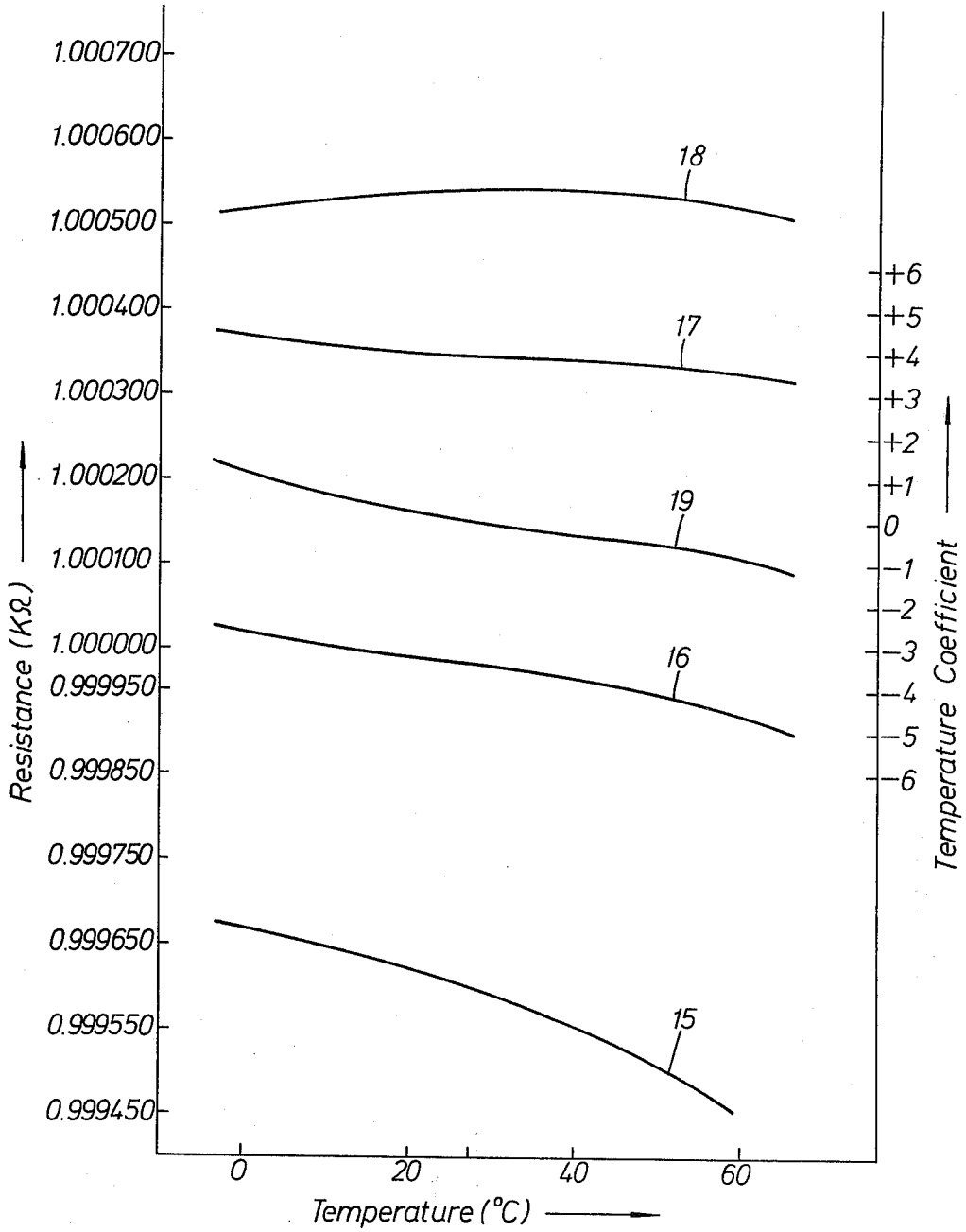
FIG. 5 graphically shows the variations of the resistance and the temperature coefficient of the resistor according to the invention as plotted against temperature.

Referring to FIGS. 3 to 5, an embodiment of the resistor with low temperature coefficient constructed in accordance with the invention will be described below in connection with the method of manufacturing the same.

Referring to FIG. 3A, there is provided a bobbin 12 which comprises a solid cylindrical body 6 which is provided with a pair of flanges 7 and 8 at its opposite end faces and also with intermediate flanges 9, 10 and 11 integral with the body 6. The spacing between the flange 7 at one end and the intermediate flange 10 is comparatively large to form a principal part, while the spacing between the flange 8 at the other end and the intermediate flange 11 is reduced to form an auxiliary part. The spacing between the intermediate flanges 10 and 11 is further reduced to form a connection part. The purpose of the flange 9 which is located intermediate the flanges 7 and 10 is to facilitate the winding operation, and may be eliminated. Alternatively, a plurality of intermediate flanges 9 may be provided if desired. A resistance wire having a low temperature coefficient of a readily available material such as manganin wire is wound around the principal part of the bobbin 12 to constitute a main resistor 13. The resistance of the main resistor 13 is chosen to be slightly greater than an intended resistance, or to have resistance value $R_1 = R_0 + \Delta R$ where $R_0$ represents the intended resistance. $\Delta R$ is on the order of 1 to 2% of $R_0$, for example. The main wire wound resistor 13 is annealed in the conventional manner, and its temperature coefficient $\alpha_1$ at the intended temperature of use $t_2$ is determined. By way of example, $0>\alpha_1>-5.0$ PPM. The purpose of increasing the resistance of the main resistor 13 by an amount $\Delta R$ is to prevent the final resistance from becoming less than the intended value $R_0$ as a result of changes in its resistance during the winding process or due to the annealing operation to stabilize the resistance.

Then, an auxiliary resistor 14 is formed of a copper wire, for example. The auxiliary resistor 14 should have a relatively low resistance as compared with that of the main resistor, and should have a temperature coefficient which is of the opposite polarity to $\alpha_1$ and which is relatively high in magnitude as compared with the temperature coefficient of the main resistor. The temperature coefficient $\alpha_2$ of the auxiliary resistor 14 at the temperature of use $t_2$ is determined, which may be between 3500 and 4500 PPM. A portion of the main wire resistor 13 is unwound and cut off so that the resistance of the main wire resistor becomes equal to $$R_o(1 - \frac{\alpha_1}{\alpha_2}).$$

Subsequently, a length of the auxiliary resistor 14 which corresponds to a resistance of $$-R_0 \frac{\alpha_1}{\alpha_2}$$

is wound around the auxiliary part of bobbin 12, and the ends of the resistors 13 and 14 are connected together by connecting them to a terminal 20 extending from the body 6 in the connection part intermediate the flanges 10 and 11 (see FIG. 3B). The ratio of $\alpha_1/\alpha_2$ is so chosen that it does not exceed 0.01.

The resistor thus obtained according to the invention comprises a series connection of the main resistor 13 and the auxiliary resistor 14 as shown in FIG. 4. Assuming that the main resistor 13, after a portion thereof having been unwound and cut off, has a resistance of $R_1$ and the auxiliary resistor 14 has a resistance of $$R_0 \frac{\alpha_1}{\alpha_1 - \alpha_2},$$

it will be appreciated that the overall temperature characteristic of the resistors 13 and 14 will be $$R_1\alpha_2 + R_0 \frac{\alpha_1}{\alpha_1 - \alpha_2}\alpha_2 = 0.$$

Since $$R_0 = \frac{\alpha_1 - \alpha_2}{-\alpha_2} R_1,$$

the overall temperature coefficient $\alpha_3$ will become completely null. However, as a matter of practice, the auxiliary resistor 14 has a resistance of $R_0\ \alpha_1/\alpha_2$ as mentioned above, so that $\alpha_3$ cannot become completely null. Nevertheless, if $\alpha_2$ is chosen to exhibit a value which is nearly 1,000 times the value of $\alpha_1$, the difference between $$\frac{\alpha_1}{\alpha_1 - \alpha_2}$$

and $$\frac{\alpha_1}{-\alpha_2}$$

will be on the order of about 0.1%, thereby enabling the temperature coefficient $\alpha_3$ to be readily reduced to less than 0.5 PPM. From the foregoing description, it will be appreciated that since the resistance of the auxiliary resistor 14 is equal to $R_0\ \alpha_1/\alpha_2$, the greater the relative magnitude of $\alpha_2$ with respect to $\alpha_1$, the less will be the difference between $R_0$ and $R_1$ or the error, and the less the quantity of the material of the auxiliary resistor 14 which is used, with consequence that the influence of its aging effect upon the overall resistance becomes reduced. In this respect, it will be noted that if a copper wire is used for the auxiliary resistor 14, it is possible to have its temperature coefficient by three orders of magnitude greater than that of the main resistor 13. It is recognized that copper wires of various sizes are readily available. Its temperature coefficient remains substantially constant over temperature change, as indicated in FIG. 2. Additionally, because a variation in the characteristic before and after it is wound on the bobbin is small, its temperature coefficient can be determined before it is wound on the bobbin.

It would appear to be obvious that the overall temperature coefficient could be nullified by a series connection of a pair of resistors having temperature coefficients of opposite polarities. In such instance, if a resistor having a resistance of 40 KΩ is to be produced, one would think of a series connection of one resistor having a resistance of 20 KΩ and a temperature coefficient of $+\alpha_1$ and another having a resistance of 20 KΩ and a temperature coefficient of $-\alpha_1$. However, in practice, it is very difficult, if not impossible, to obtain resistors having temperature coefficients which have an exact value of $+\alpha_1$ and $-\alpha_1$, respectively, at the temperature of use. Because of variation in the temperature coefficient found from resistor to resistor, a temperature coefficient of a relatively high magnitude remains when a pair of such resistors are combined. In addition, it will be recognized that materials having temperature coefficients such as $+\alpha_1$ and $-\alpha_1$ which are of exactly same magnitude and opposite in polarity are only rarely found, and if existed, are not readily available. The availability will be further reduced if the requirement for stability of the temperature coefficient is added for the respective ones. As a result, it has been almost impossible in the prior art to produce resistors having a very small temperature coefficient and a good stability, on a mass production basis.

By contrast, in accordance with the invention, a material having a good stability and a low temperature coefficient is used for the main wire wound resistor, and its temperature coefficient is compensated for by the addition of the auxiliary resistor which has a high temperature coefficient and a small resistance, thereby enabling a mass production of stable composite resistors. It will be noted that the point where the temperature coefficient-temperature characteristic curve crosses the abscissa in FIG. 2 can be freely chosen by a suitable choice of the resistance of the auxiliary resistor. By using an auxiliary resistor having a negative temperature coefficient, the abscissa crossing point of FIG. 2 can be shifted to the left of the temperature $t_1$. By adding an auxiliary resistor to a resistor having a resistance-temperature characteristic which is in the form of a quadratic curve having a pole as indicated in FIG. 1, the temperature coefficient can be nullified at any desired temperature.

In a specific example, a manganin resistance wire having a diameter of 0.1 mm and a resistivity of 0.5Ω/cm is used for the main resistor. A length of about 20 meters of this resistance wire corresponding to a little over 1 KΩ is wound on a ceramic bobbin and annealed, and the temperature coefficient of the main resistor determined at 27°C, which is found to be −4 PPM/°C. A portion of the main resistor is unwound and removed so that the remaining resistor has a resistance of 999Ω. The resistance-temperature characteristic of the resulting main resistor is represented by a curve 15 in FIG. 5, and its temperature coefficient-temperature characteristic by a curve 16. A polyurethane copper wire having a diameter of 0.2 mm, a resistivity of about 0.6Ω/m and a temperature coefficient as represented by a curve 17 (x$10^3$), namely, a temperature coefficient of +4000 PPM/°C at 27°C, is used for the auxiliary resistor. A length of this wire corresponding to 1

$$1\ K\Omega \times \frac{4}{4000} = 1\Omega,$$

or 1.7 meters, is wound on the bobbin and electrically connected with the main resistor. The resulting composite resistor exhibits a resistance-temperature characteristic as represented by a curve 18 and a temperature coefficient-temperature characteristic as represented by a curve 19. It will be noted that the temperature coefficient becomes null at 27.5°C.

Having described the invention, what is claimed is:

1. A resistor having a low thermal coefficient comprising a main wire resistor having a thermal coefficient of $\alpha_1$, and an auxiliary resistor having a value of resistance less than that of said main resistor connected in series with the main wire resistor, said auxiliary resistor having a thermal coefficient of $\alpha_2$ which is of opposite sign to that of $\alpha_1$, the resistance value of said auxiliary resistor being $R_0\ \alpha_1/\alpha_2$, where $R_0$ represents the composite series resistance of the main wire resistor and the auxiliary resistor, and where the ratio $\alpha_1/\alpha_2$ does not exceed 0.01.

2. A resistor according to claim 1 in which the auxiliary resistor comprises a copper wire.

3. A resistor according to claim 1, further including a common bobbin on which the main resistor and the auxiliary resistor are wound.

4. A resistor according to claim 2 in which the bobbin is formed with at least four flanges which divide the length of the bobbin into a principal part around which the main resistor is wound, an auxiliary part around which the auxiliary resistor is wound, and a connection part intermediate the principal and auxiliary parts, one end each of the main resistor and the auxiliary resistor being connected together at the connection part.

5. A resistor according to claim 1 in which the main resistor is formed of a material which exhibits a resistance-temperature characteristic in the form of a quadratic curve having a pole, and in which the auxiliary resistor is formed of a material which exhibits a substantially linear resistance-temperature characteristic.

* * * * *